US011193403B2

(12) United States Patent
Okamoto

(10) Patent No.: US 11,193,403 B2
(45) Date of Patent: Dec. 7, 2021

(54) VALVE SPRING RETAINER AND INTERNAL COMBUSTION ENGINE

(71) Applicant: YAMAHA HATSUDOKI KABUSHIKI KAISHA, Iwata (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 161 days.

(21) Appl. No.: 16/621,714

(22) PCT Filed: Apr. 27, 2018

(86) PCT No.: PCT/JP2018/017282
§ 371 (c)(1),
(2) Date: Dec. 12, 2019

(87) PCT Pub. No.: WO2019/003628
PCT Pub. Date: Jan. 3, 2019

(65) Prior Publication Data

US 2021/0293161 A1 Sep. 23, 2021

(30) Foreign Application Priority Data

Jun. 30, 2017 (JP) ..... JP2017-128789

(51) Int. Cl.
*F01L 1/18* (2006.01)
*F01L 3/10* (2006.01)
(Continued)

(52) U.S. Cl.
CPC ..... *F01L 3/10* (2013.01); *F01L 1/047* (2013.01); *F01L 1/181* (2013.01); *F01L 1/462* (2013.01); *F01L 2305/00* (2020.05)

(58) Field of Classification Search
CPC ... F01L 3/10; F01L 1/462; F01L 1/181; F01L 1/047; F01L 2305/00
See application file for complete search history.

(56) References Cited

U.S. PATENT DOCUMENTS 5,226,229 A 7/1993 Pierce
5,275,376 A 1/1994 Rich
(Continued)

FOREIGN PATENT DOCUMENTS

DE 29 49 413 A1 6/1981
DE 10 2008 027 886 A1 12/2009
(Continued)

OTHER PUBLICATIONS

Official Communication issued in International Patent Application No. PCT/JP2018/017282, dated Jul. 17, 2018.

*Primary Examiner* — Zelalem Eshete
(74) *Attorney, Agent, or Firm* — Keating and Bennett, LLP

(57) ABSTRACT

An internal combustion engine switches valve operation states, reduces or prevents wear of a cam and a rocker arm, and reduces the size of the cylinder head to ensure a sufficient valve lift amount. A valve spring retainer includes a cylindrical portion including a first through hole with an inner diameter decreases from the first end portion toward the second end portion, a cone-shaped portion including a second through hole with an inner diameter increases as it extends away from the second end portion of the cylindrical portion, and a flange portion extending radially outward from the cone-shaped portion. An outer diameter of the cylindrical portion is constant from the first end portion to the second end portion, and an outer diameter of the cone-shaped portion increases as it extends away from the second end portion.

3 Claims, 9 Drawing Sheets

(51) Int. Cl.
*F01L 1/047* (2006.01)
*F01L 1/46* (2006.01)

(56) References Cited

U.S. PATENT DOCUMENTS

| | | | |
|---|---|---|---|
| 2007/0251480 | A1 | 11/2007 | Eguchi et al. |
| 2008/0296402 | A1 | 12/2008 | Grant et al. |

FOREIGN PATENT DOCUMENTS

| | | | | | |
|---|---|---|---|---|---|
| EP | 1288447 | A2 * | 3/2003 | ..... | F01L 3/10 |
| EP | 2 211 031 | A1 | 7/2010 | | |
| JP | 62-279217 | A | 12/1987 | | |
| JP | 05-010712 | U | 2/1993 | | |
| JP | 06-029442 | Y2 | 8/1994 | | |
| JP | 06-341306 | A | 12/1994 | | |
| WO | WO-2016052729 | A1 * | 4/2016 | ..... | F01L 13/00 |

* cited by examiner

VALVE SPRING RETAINER AND INTERNAL COMBUSTION ENGINE

BACKGROUND OF THE INVENTION

1. Field of the Invention

The present invention relates to a valve spring retainer and an internal combustion engine.

2. Description of the Related Art

As disclosed in Japanese Utility Model Publication for Opposition No. H6-29442, for example, there are conventional internal combustion engines that include a cam provided on a cam shaft, a valve that opens/closes an intake opening or an exhaust opening, a valve spring retainer to which a valve is fitted with a cotter therebetween, and a rocker arm that includes a contact portion that contacts with one end portion of the valve and a roller that contacts with the cam. With such an internal combustion engine, since the roller rotates together with the rotation of the cam, it is possible to reduce the wear of the cam and the rocker arm. Thus, it is possible to realize effects such as improving the fuel efficiency.

With the internal combustion engine disclosed in Japanese Utility Model Publication for Opposition No. H6-29442, the shape of the valve spring retainer is formed into a skirt-like shape so as to avoid interference between the roller and the valve spring retainer. That is, the valve spring retainer has such a shape that it gradually flares radially outward from the shaft center of the valve while extending from the end portion toward the other end portion of the valve.

SUMMARY OF THE INVENTION

The inventor of preferred embodiments of the present invention attempted to realize a variable valve device with which the valve operation state is able to be switched by making the roller movable relative to the rocker arm, while making use of the advantage of the internal combustion engine described above. However, where the roller is movable relative to the rocker arm, the roller will be closer to the valve spring retainer.

One may consider moving the position of the rocker arm away from the valve spring retainer in order to avoid interference between the roller and the valve spring retainer. In such a case, however, there is a need to also change the position of the cam shaft, etc., and this will increase the size of the cylinder head of the internal combustion engine. On the other hand, one may consider moving the position of the valve spring retainer away from the rocker arm without changing the position of the rocker arm. In such a case, however, it may not be possible to ensure the needed valve lift amount.

Preferred embodiments of the present invention provide valve spring retainers with each of which, it is possible both to reduce the size of a cylinder head of an internal combustion engine and to ensure a sufficient valve lift amount. Other preferred embodiments of the present invention provide internal combustion engines that are each able to switch the valve operation state in which there is little wear of a cam and a rocker arm, and to reduce the size of the cylinder head and to ensure a sufficient valve lift amount.

A valve spring retainer according to a preferred embodiment of the present invention includes a cylindrical portion including a first end portion and a second end portion, the cylindrical portion including a first through hole with an inner diameter that decreases from the first end portion toward the second end portion; a cone-shaped portion extending from the second end portion of the cylindrical portion along an axial direction of the cylindrical portion, the cone-shaped portion including a second through hole with an inner diameter that increases as it extends away from the second end portion; and a flange portion extending radially outward from the cone-shaped portion. An outer diameter of the cylindrical portion is constant from the first end portion to the second end portion; and an outer diameter of the cone-shaped portion increases as it extends away from the second end portion.

With the valve spring retainer described above, since the outer diameter of the cylindrical portion is constant from the first end portion to the second end portion, it is possible to ensure a space radially outward of the cylindrical portion. Therefore, it is possible to avoid interference between a roller of a rocker arm and the valve spring retainer without moving the position of the rocker arm away from the valve spring retainer and without moving the position of the valve spring retainer away from the rocker arm. Therefore, it is possible both to reduce the size of the cylinder head of an internal combustion engine and to ensure a sufficient valve lift amount.

According to a preferred embodiment of the present invention, the cone-shaped portion includes an inner surface that defines the second through hole. The inner surface includes a surface that is perpendicular or substantially perpendicular to an axial direction of the cone-shaped portion, and a sloped surface that extends radially outward while extending away from the surface in the axial direction.

According to the preferred embodiment described above, it is possible to increase an internal space of the second through hole of the valve spring retainer. Therefore, when the valve spring retainer moves together with the valve, the valve spring retainer is unlikely to interfere with other members (a valve stem seal, etc.). Therefore, it is possible to ensure a sufficient valve lift amount without increasing the size of the cylinder head.

An internal combustion engine according to a preferred embodiment of the present invention includes a cylinder head; a port in the cylinder head; a valve installed in the cylinder head that opens/closes the port; a cam shaft rotatably supported on the cylinder head; a cam provided on the cam shaft; and a rocker arm. The rocker arm includes a first arm including a supported portion pivotally supported on the cylinder head and a contact portion that contacts with the valve, a second arm pivotally supported on the first arm, and a roller rotatably attached to the second arm and located between the supported portion and the contact portion of the first arm. The internal combustion engine includes a connector that removably connects the first arm and the second arm; a cotter attached to the valve; a valve spring retainer to which the cotter is fitted and through which the valve passes; and a coil spring that includes a first spring end portion supported on the valve spring retainer and a second spring end portion supported on the cylinder head. The valve spring retainer includes a cylindrical portion including a first end portion and a second end portion, the cylindrical portion including a first through hole with an inner diameter decreases from the first end portion toward the second end portion; a cone-shaped portion extending from the second end portion of the cylindrical portion along an axial direction of the cylindrical portion, the cone-shaped portion including a second through hole with an inner diameter increases as it extends away from the second end portion; and a flange portion extending radially outward from the cone-shaped portion and supporting the first spring end portion of the coil spring. An outer diameter of the cylindrical portion is constant from the first end portion to the second end portion; and an outer diameter of the cone-shaped portion increases as it extends away from the second end portion.

With the internal combustion engine described above, since the outer diameter of the cylindrical portion of the valve spring retainer is constant from the first end portion to the second end portion, it is possible to ensure a space radially outward of the cylindrical portion. Therefore, it is possible to avoid interference between the roller of the rocker arm and the valve spring retainer without moving the position of the rocker arm away from the valve spring retainer and without moving the position of the valve spring retainer away from the rocker arm. Therefore, despite being an internal combustion engine capable of switching the valve operation state, there is little wear of the cam and the rocker arm, and it is possible both to reduce the size of the cylinder head and to ensure a sufficient valve lift amount.

According to a preferred embodiment of the present invention, the internal combustion engine includes a second coil spring at least a portion of which is located on a side of the valve spring retainer, wherein the second coil spring is in contact with the second arm and urges the second arm toward the cam.

With the internal combustion engine described above, the rocker arm is located in the vicinity of the valve spring retainer while avoiding interference between the roller of the rocker arm and the valve spring retainer. Therefore, the rocker arm is located at a position closer to the port. With this structural arrangement, the second coil spring is able to be located at a position closer to the port. Therefore, there is a need for fewer members to support the second coil spring, and it is possible to realize a reduction in weight.

According to a preferred embodiment of the present invention, the second arm is supported on the first arm so that when the second arm is disconnected from the first arm, the roller moves between a first position and a second position that is farther away from the cam than the first position. When the roller is at the second position, at least a portion of the roller is located closer to the second end portion than to the first end portion of the valve spring retainer and closer to an axis of the valve spring retainer than to the flange portion, on a cross section that passes through the axis of the valve spring retainer and that is perpendicular or substantially perpendicular to an axial direction of the cam shaft.

According to the preferred embodiment described above, the distance between the roller and the valve spring retainer is short. Therefore, it is possible to further reduce the size of the cylinder head of the internal combustion engine.

According to preferred embodiments of the present invention, it is possible to provide a valve spring retainer with which it is possible both to reduce the size of the cylinder head of an internal combustion engine and to ensure a sufficient valve lift amount. It is also possible to provide an internal combustion engine capable of switching the valve operation state, wherein there is little wear of a cam and a rocker arm, and it is possible both to reduce the size of the cylinder head and to ensure a sufficient valve lift amount.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
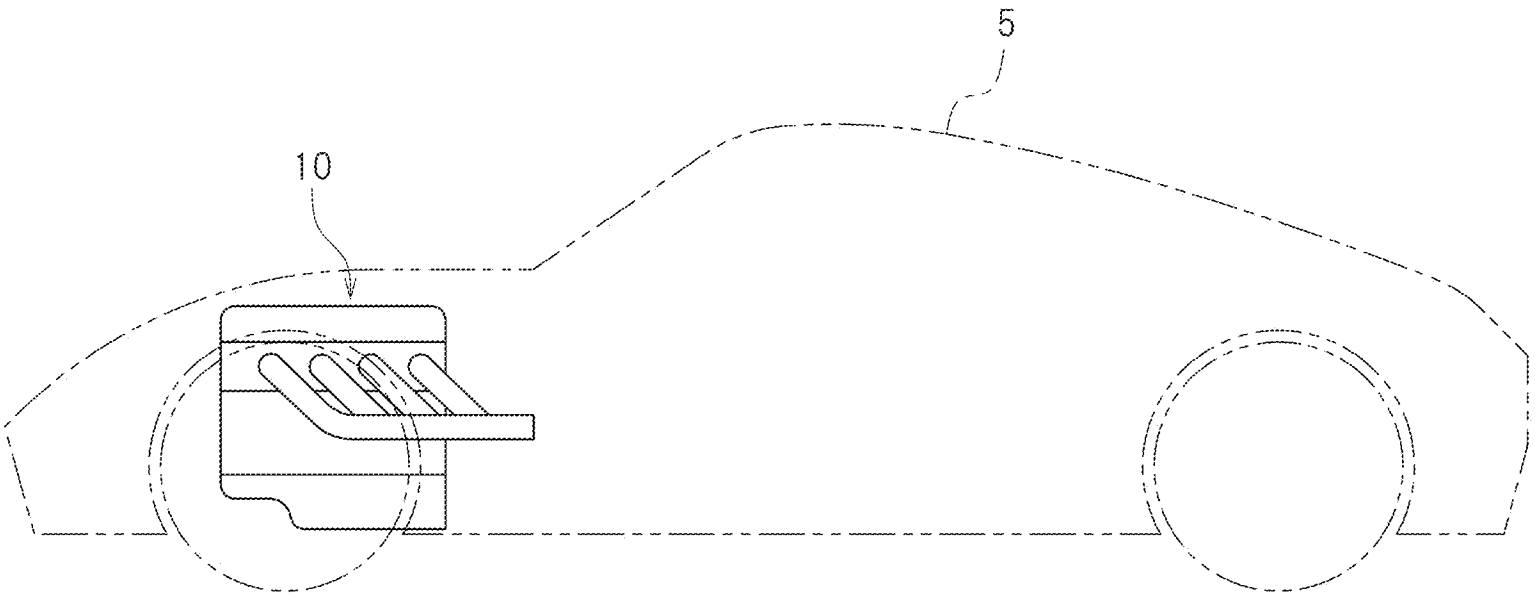
FIG. 1 is a view showing an example of an internal combustion engine according to a preferred embodiment of the present invention installed in an automobile.

Preferred embodiments of the present invention will now be described with reference to the drawings. An internal combustion engine according to the present preferred embodiment is installed in a vehicle and used as the drive source of the vehicle. There is no limitation on the type of the vehicle, which may be a straddled vehicle such as a motorcycle, an auto tricycle or an ATV (All Terrain Vehicle) or may be an automobile. For example, an internal combustion engine 10 may be provided in the engine room of an automobile 5 as shown in FIG. 1.

Figure 2:
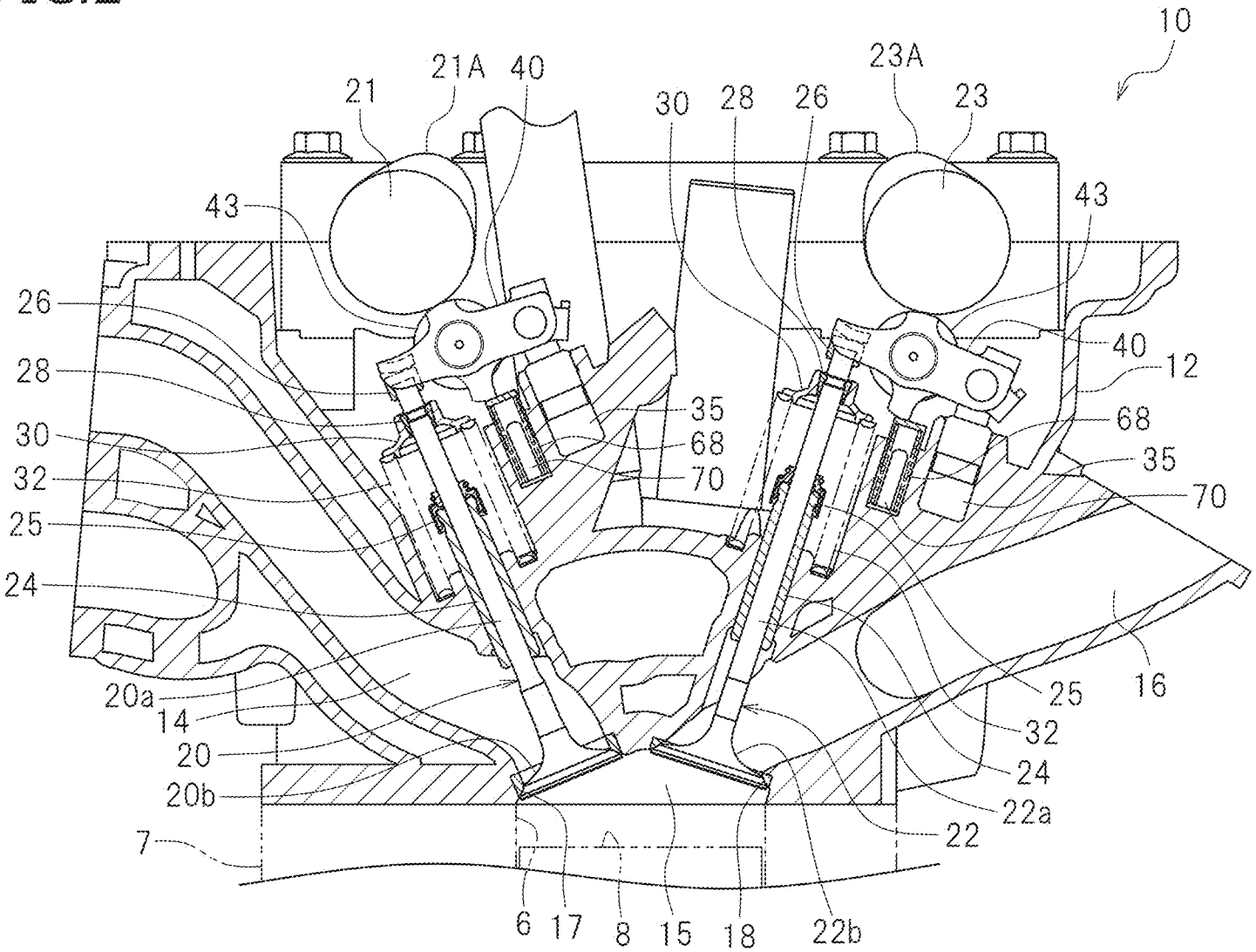
FIG. 2 is a partial cross-sectional view of the internal combustion engine.

The internal combustion engine 10 according to the present preferred embodiment is preferably a multi-cylinder engine including a plurality of cylinders. The internal combustion engine 10 is a 4-stroke engine that includes the intake stroke, the compression stroke, the combustion stroke, and the exhaust stroke. FIG. 2 is a partial cross-sectional view of the internal combustion engine 10. As shown in FIG. 2, the internal combustion engine 10 includes a crankcase (not shown), a cylinder body 7 connected to the crankcase, and a cylinder head 12 connected to the cylinder body 7. A crankshaft (not shown) is located inside the crankcase. A plurality of cylinders 6 are provided inside the cylinder body 7. A piston 8 is located inside each cylinder 6. The piston 8 and the crankshaft are connected by a connecting rod (not shown).

An intake cam shaft 23 and an exhaust cam shaft 21 are rotatably supported on the cylinder head 12. Intake cams 23A are provided on the intake cam shaft 23, and exhaust cams 21A are provided on the exhaust cam shaft 21.

Intake ports 16 and exhaust ports 14 are provided in the cylinder head 12. An intake opening 18 is provided at one end of the intake port 16. An exhaust opening 17 is provided on one end of the exhaust port 14. The intake port 16 communicates with a combustion chamber 15 through the intake opening 18. The exhaust port 14 communicates with the combustion chamber 15 through the exhaust opening 17. The intake port 16 guides the mixed gas of the air and the fuel into the combustion chamber 15. The exhaust port 14 guides the exhaust gas discharged from the combustion chamber 15 to the outside.

Intake valves 22 and exhaust valves 20 are installed in the cylinder head 12. The intake valve 22 opens/closes the intake opening 18 of the intake port 16. The exhaust valve 20 opens/closes the exhaust opening 17 of the exhaust port 14. The intake valve 22 and the exhaust valve 20 are so-called poppet valves. The intake valve 22 includes a shaft portion 22*a* and an umbrella portion 22*b*, and the exhaust valve 20 includes a shaft portion 20*a* and an umbrella portion 20*b*. The configuration of the intake valve 22 and the configuration of the exhaust valve 20 are similar to each other, and the configuration of the intake valve 22 will be described below while omitting the description of the configuration of the exhaust valve 20. The shaft portion 22*a* of the intake valve 22 is slidably supported on the cylinder head 12 with a cylinder-shaped sleeve 24 therebetween. A valve stem seal 25 is attached to one end of the sleeve 24 and the shaft portion 22*a* of the intake valve 22. The shaft portion 22*a* of the intake valve 22 extends through the sleeve 24 and the valve stem seal 25. A tappet 26 is fitted to the tip of the shaft portion 22*a*.

Figure 3:
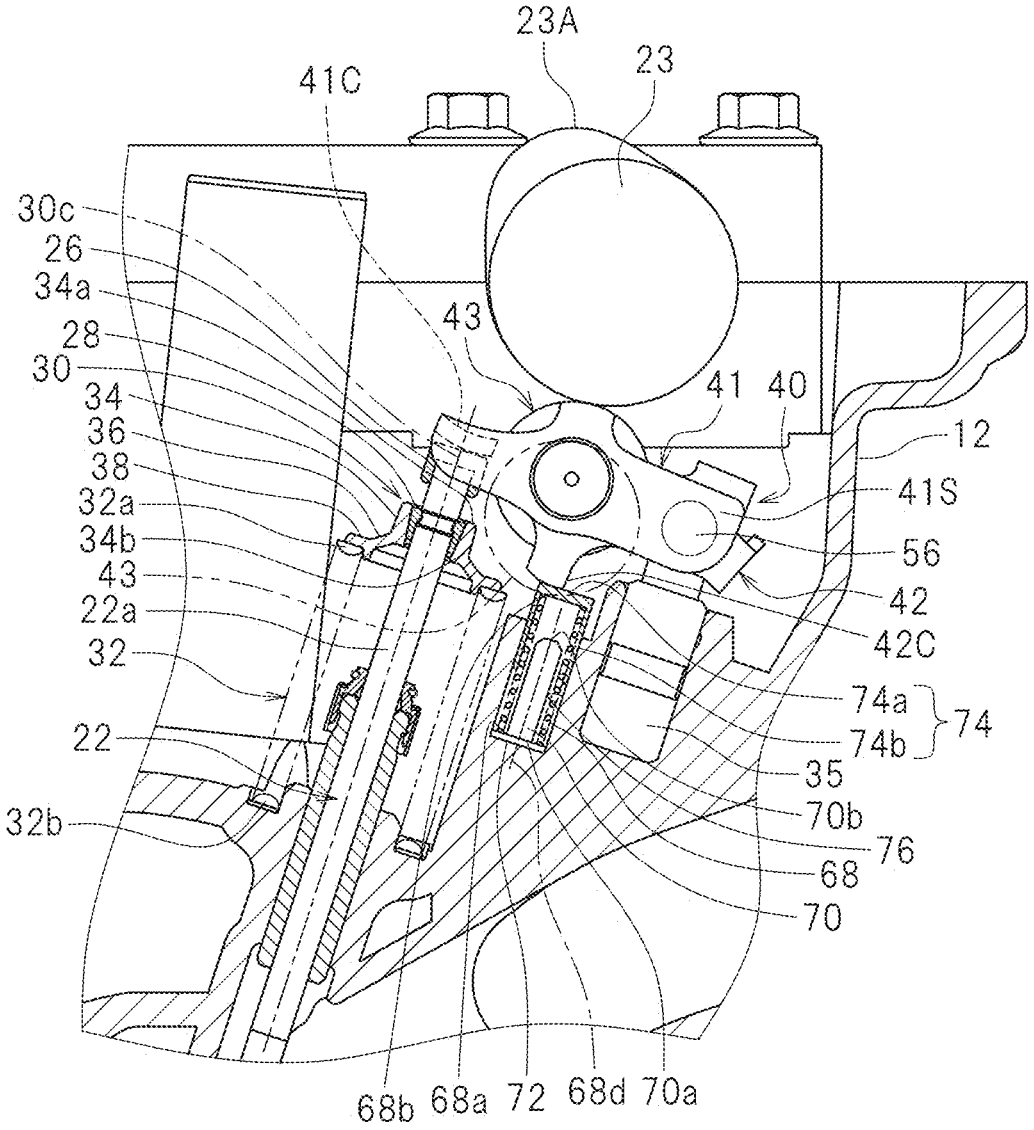
FIG. 3 is a partial enlarged cross-sectional view of the internal combustion engine.

As shown in FIG. 3, a cotter 28 is attached to the shaft portion 22*a* of the intake valve 22. The cotter 28 is fitted to a valve spring retainer 30. The valve spring retainer 30 is secured to the intake valve 22 with the cotter 28 therebetween. The valve spring retainer 30 is able to move, together with the intake valve 22, in an axial direction of the intake valve 22. The intake valve 22 extends through the valve spring retainer 30.

Figure 4:
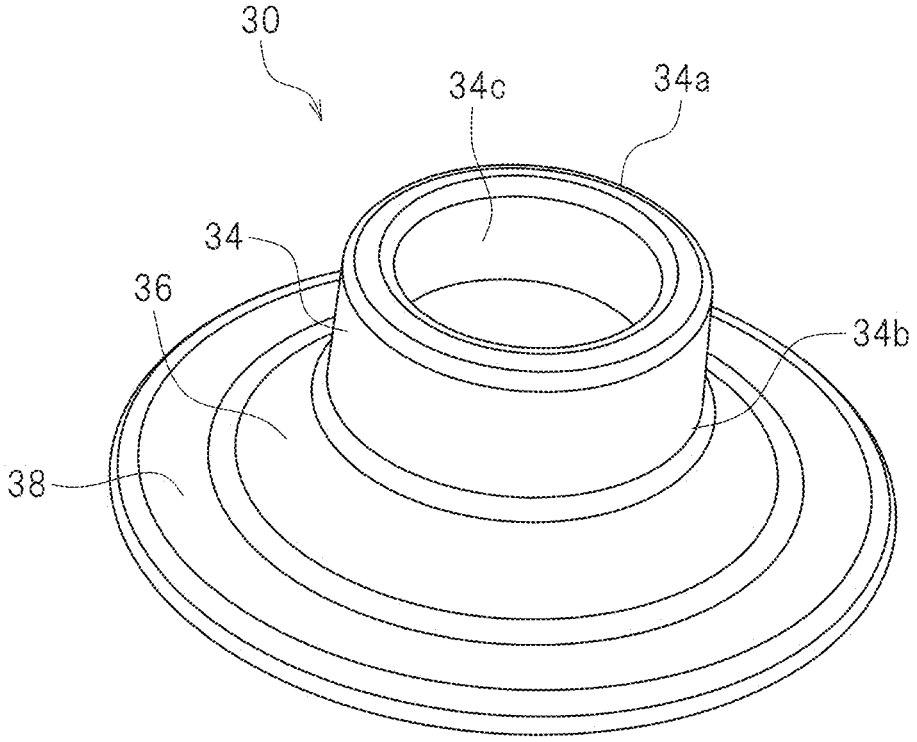
FIG. 4 is a perspective view of a valve spring retainer.
Figure 5:
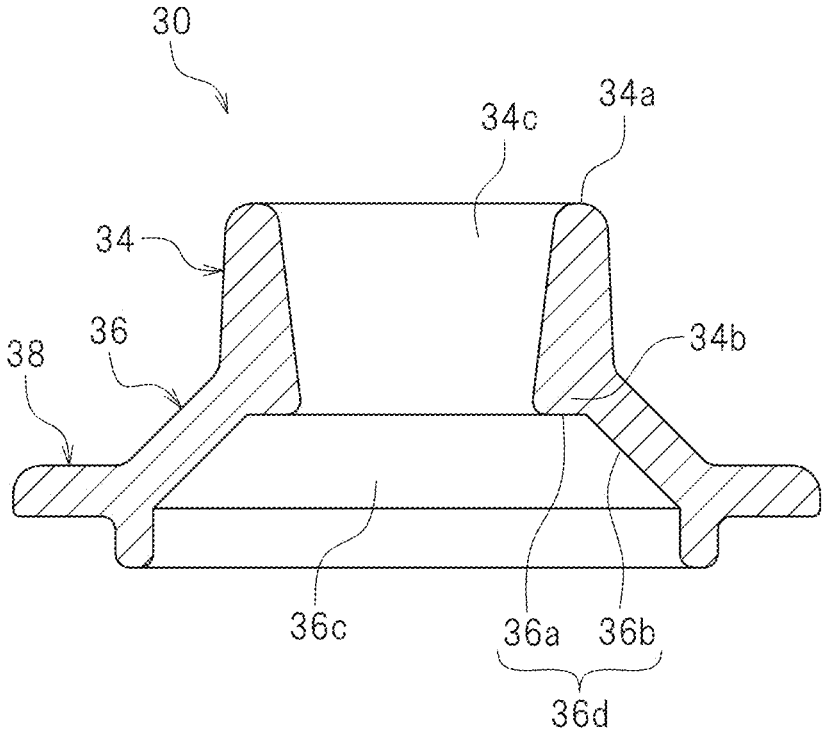
FIG. 5 is a vertical cross-sectional view of the valve spring retainer.

FIG. 4 is a perspective view of the valve spring retainer 30. FIG. 5 is a vertical cross-sectional view of the valve spring retainer 30. As shown in FIG. 4 and FIG. 5, the valve spring retainer 30 includes a cylindrical portion 34, a cone-shaped portion 36, and a flange portion 38 extending radially outward from the cone-shaped portion 36.

The cylindrical portion 34 has a cylinder shape and includes a first end portion 34*a* and a second end portion 34*b*. The cylindrical portion 34 includes a first through hole 34*c* with an inner diameter decreases from the first end portion 34*a* toward the second end portion 34*b*. The outer diameter of the cylindrical portion 34 is constant from the first end portion 34*a* to the second end portion 34*b*. Note that "the outer diameter of the cylindrical portion 34 being constant" means that the outer diameter of the cylindrical portion 34 is substantially constant. For example, the outer diameter is regarded as being substantially constant when the difference between the maximum value of the outer diameter and the minimum value thereof is within about ±5% the average value of the outer diameter. Note, however, that the difference between the maximum value of the outer diameter and the minimum value thereof may be within about ±3%, or within about ±1%, of the average value.

The cone-shaped portion 36 extends from the second end portion 34*b* of the cylindrical portion 34 along an axial direction of the cylindrical portion 34. The cone-shaped portion 36 has a cone shape, and the outer diameter of the cone-shaped portion 36 increases as it extends away from the second end portion 34*b*. The cone-shaped portion 36 includes a second through hole 36*c* with an inner diameter increases as it extends away from the second end portion 34*b*. The cone-shaped portion 36 includes an inner surface 36*d* that defines the second through hole 36*c*. The inner surface 36*d* includes a surface 36*a* that is perpendicular or substantially perpendicular to an axial direction of the cone-shaped portion 36, and a sloped surface 36*b* that extends radially outward while extending away from the surface 36*a* in the axial direction.

As shown in FIG. 3, the internal combustion engine 10 includes a valve spring 32 that provides the intake valve 22 with a force in the direction of closing the intake opening 18 (the upward direction in FIG. 3). The valve spring 32 is preferably a compression coil spring, and includes a first spring end portion 32*a* supported on the valve spring retainer 30 and a second spring end portion 32*b* supported on the cylinder head 12.

Figure 6:
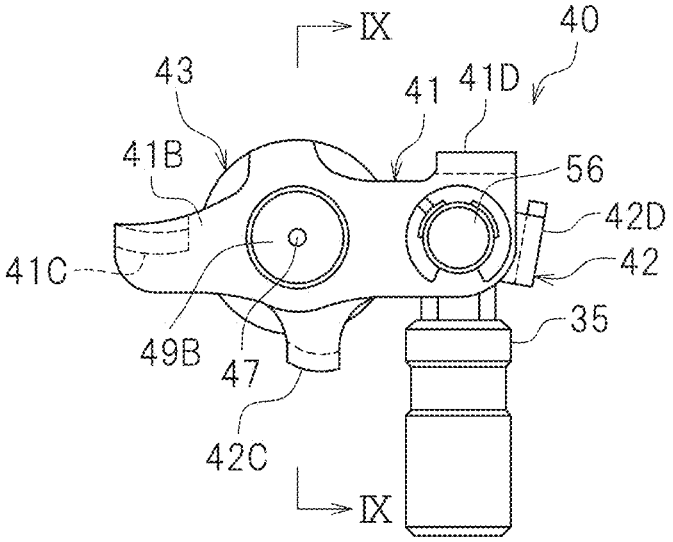
FIG. 6 is a side view of a rocker arm and a support.
Figure 7:
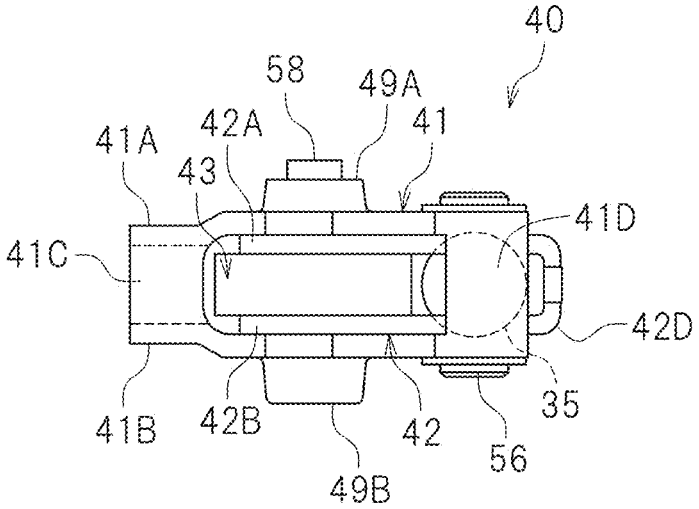
FIG. 7 is a plan view of the rocker arm and the support.

The internal combustion engine 10 includes a rocker arm 40 that receives a force from the intake cam 23A to open/close the intake valve 22. The rocker arm 40 is pivotally supported on the cylinder head 12 with a support 35 therebetween. FIG. 6 is a side view of the rocker arm 40 and the support 35, and FIG. 7 is a plan view of the rocker arm 40 and the support 35. The rocker arm 40 includes a first arm 41, a second arm 42, and a roller 43.

Figure 8:
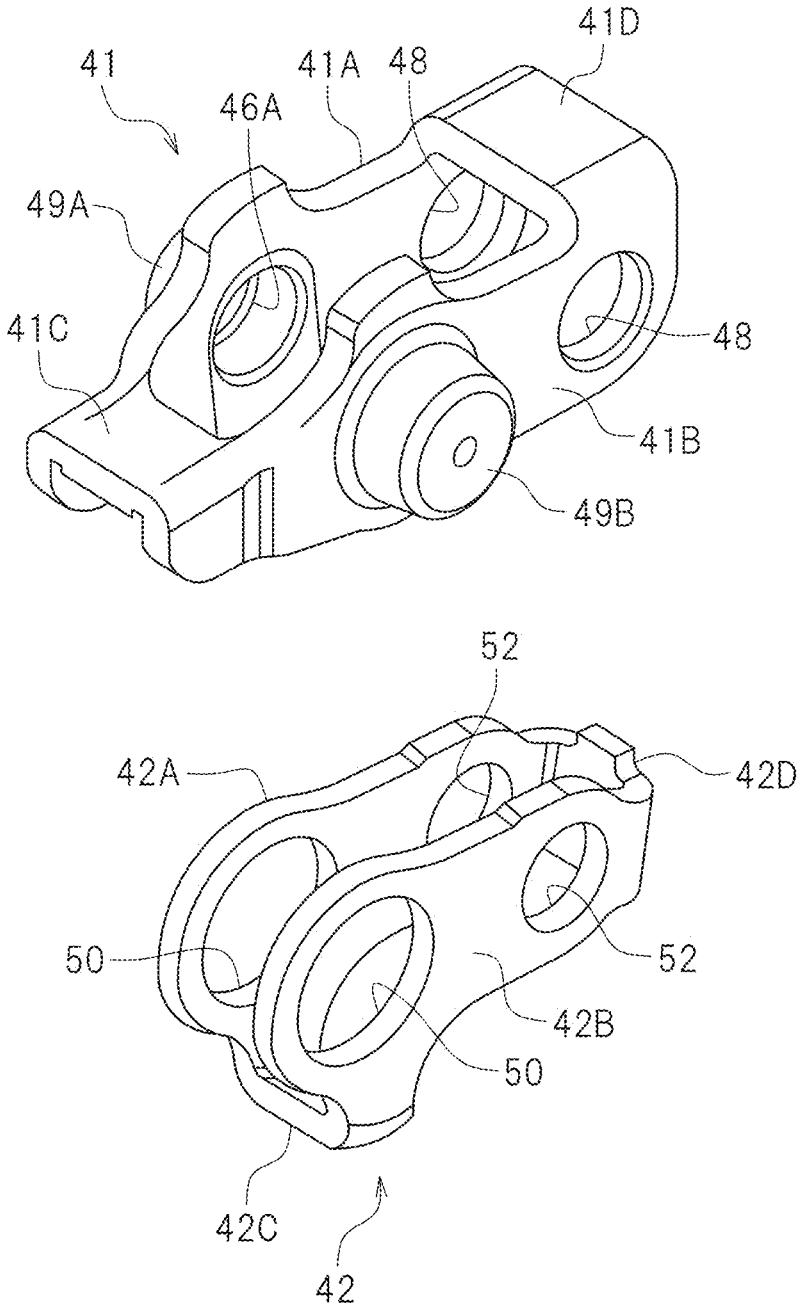
FIG. 8 is an exploded perspective view of a first arm and a second arm of the rocker arm.

FIG. 8 is an exploded perspective view of the first arm 41 and the second arm 42. The first arm 41 includes a plate 41A, a plate 41B, a contact plate 41C, and a connecting plate 41D. The plate 41A and the plate 41B are parallel or substantially parallel to each other. The contact plate 41C and the connecting plate 41D extend across the plate 41A and the plate 41B. The contact plate 41C and the connecting plate 41D connect together the plate 41A and the plate 41B. The plate 41A includes a hole 46A and a hole 48. The plate 41B includes a hole 46B (see FIG. 9) and the hole 48. The holes 46A, 46B, and 48 extend in the direction parallel or substantially parallel to the axial line direction of the intake cam shaft 23 (see FIG. 3).

Figure 9:
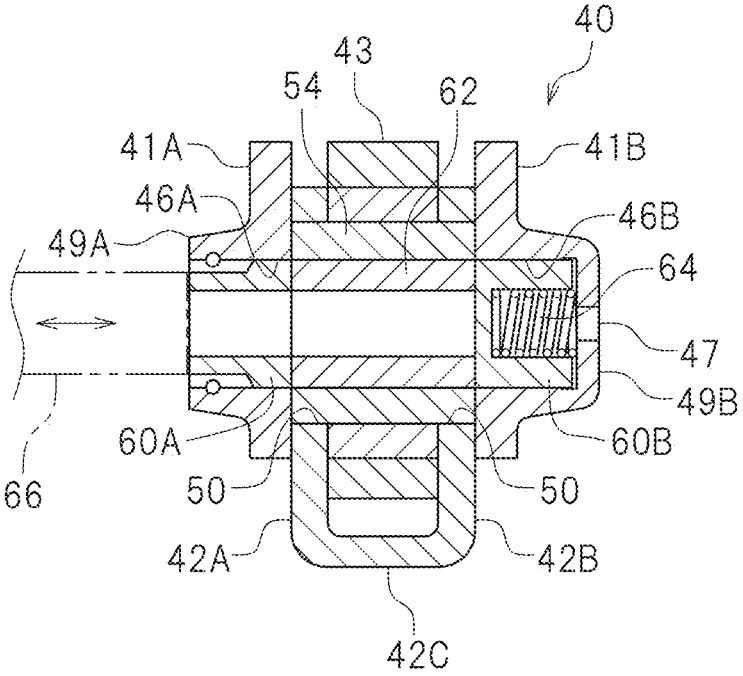
FIG. 9 is a cross-sectional view taken along line IX-IX of FIG. 6.

FIG. 9 is a cross-sectional view taken along line IX-IX of FIG. 6. As shown in FIG. 9, a cylinder-shaped boss portion 49A is provided around the hole 46A of the plate 41A. A connecting pin 60A is slidably inserted inside the hole 46A. A bottomed cylinder-shaped cover portion 49B is provided around the hole 46B of the plate 41B. The cover portion 49B is provided with a hole 47 having a smaller diameter than the hole 46B, but the hole 47 may be omitted. A connecting pin 60B is slidably inserted inside the hole 46B. A spring 64 is located inside the hole 46B. The spring 64 is positioned between the cover portion 49B and the connecting pin 60B, and urges the connecting pin 60B toward the plate 41A.

The second arm 42 is located on the inner side of the first arm 41. That is, the second arm 42 is located between the plate 41A and the plate 41B. As shown in FIG. 8, the second arm 42 includes a plate 42A, a plate 42B, a contact plate 42C, and a connecting plate 42D. The plate 42A and the plate 42B are arranged parallel or substantially parallel to each other. The contact plate 42C and the connecting plate 42D extend across the plate 42A and the plate 42B. The contact plate 42C and the connecting plate 42D connect together the plate 42A and the plate 42B. The plate 42A and the plate 42B include a hole 50 and a hole 52, respectively.

As shown in FIG. 9, the cylinder-shaped roller 43 is rotatably supported on the hole 50 of the plate 42A and the hole 50 of the plate 42B. Specifically, a cylinder-shaped collar 54 is inserted through the holes 50 of the plate 42A and the plate 42B. The roller 43 is rotatably supported on the collar 54. A connecting pin 62 is slidably inserted inside the collar 54. Since the collar 54 is located inside the holes 50, the connecting pin 62 is slidably inserted inside the holes 50.

Note that the collar 54 is not always necessary. The connecting pin 62 may rotatably support the roller 43.

An outer diameter of the connecting pin 60B is less than or equal to an inner diameter of the collar 54. The connecting pin 60B is able to be inserted inside the collar 54. An outer diameter of the connecting pin 62 is less than or equal to an inner diameter of the hole 46A. The connecting pin 62 is able to be inserted inside the hole 46A. In the present preferred embodiment, the inner diameter of the collar 54 and the inner diameter of the hole 46A are equal to each other. The outer diameter of the connecting pin 60B, the outer diameter of the connecting pin 62, and an outer diameter of the connecting pin 60A are equal or substantially equal to each other.

As shown in FIG. 6, the support 35, the first arm 41 and the second arm 42 are connected together by a support pin 56. The support pin 56 is inserted through the hole 48 of the plate 41A and the hole 48 of the plate 41B of the first arm 41, and the hole 52 of the plate 42A and the hole 52 of the plate 42B of the second arm 42. The first arm 41 and the second arm 42 are pivotally supported on the support 35 by the support pin 56. The second arm 42 is pivotally supported on the first arm 41 by the support pin 56.

As shown in FIG. 9, a connection switch pin 66 is located on the side of the rocker arm 40. The connection switch pin 66 is able to move in the direction toward the connecting pin 60A and in the direction away from the connecting pin 60A.

Figure 10:
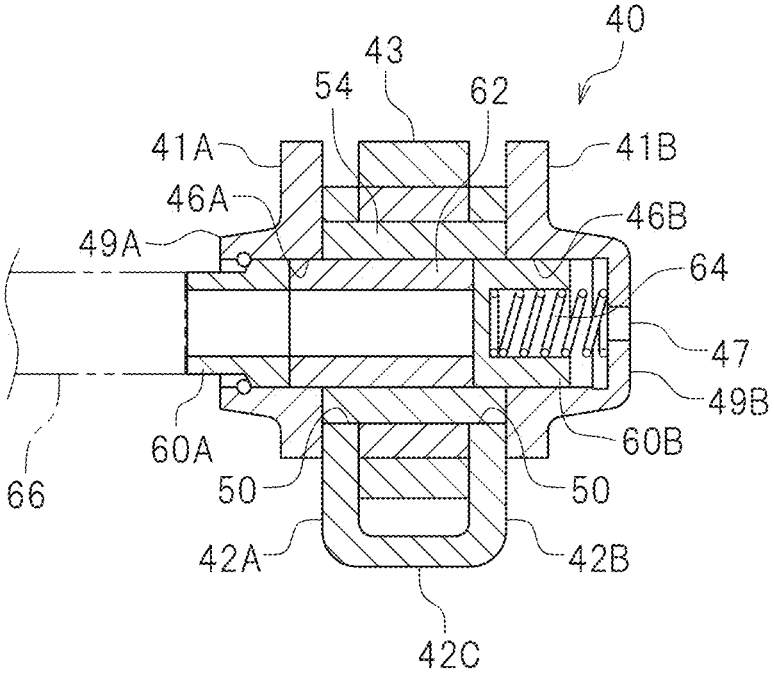
FIG. 10 is equivalent to FIG. 9, showing the rocker arm in the connected state.
Figure 11:
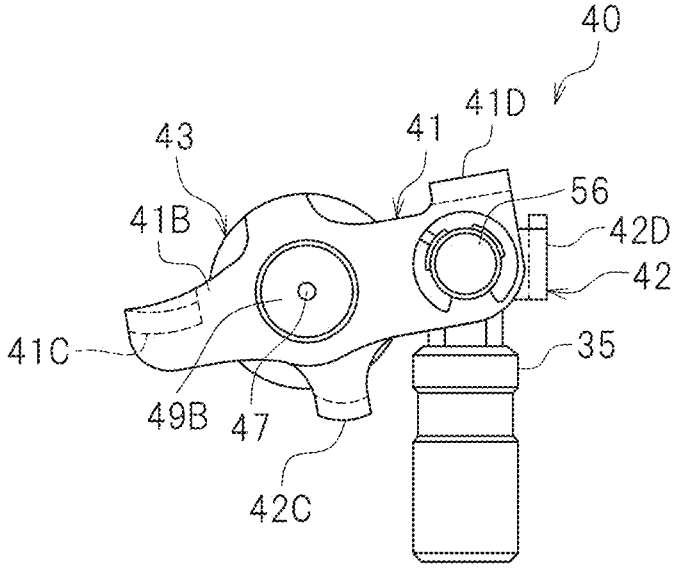
FIG. 11 is a side view showing the rocker arm in the connected state that has pivoted relative to the support.

As shown in FIG. 10, when the connection switch pin 66 moves in the direction away from the connecting pin 60A, the connecting pins 60A, 62 and 60B slide leftward in FIG. 10 due to the force of the spring 64. Thus, the connecting pin 60B is located inside the hole 46B and inside the hole 50 (specifically, inside the collar 54), and the connecting pin 62 is located inside the hole 50 (specifically, inside the collar 54) and inside the hole 46A. This state will hereinafter be referred to as the connected state. In the connected state, the first arm 41 and the second arm 42 are connected together by the connecting pin 60B and the connecting pin 62. As a result, as shown in FIG. 11, the first arm 41 and the second arm 42 are, as a single unit, pivotable about the axis of the support pin 56.

Figure 12:
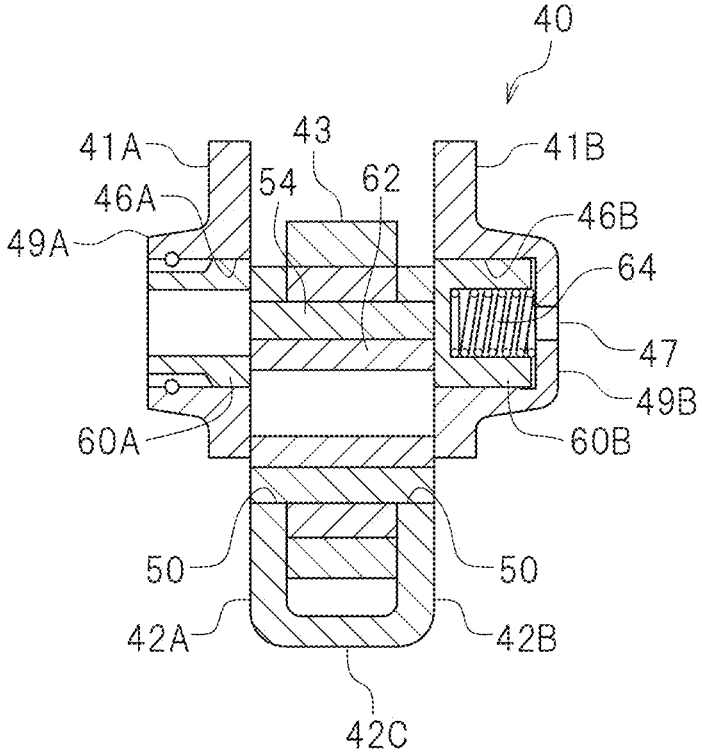
FIG. 12 is equivalent to FIG. 9, showing the rocker arm when the second arm pivots relative to the first arm.
Figure 13:
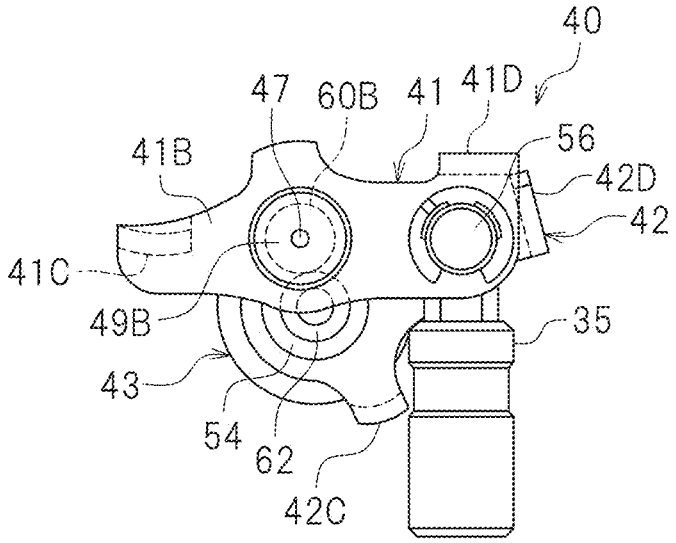
FIG. 13 is a side view showing the rocker arm and the support when the second arm pivots relative to the first arm.

As shown in FIG. 9, the connection switch pin 66 moves toward the connecting pin 60A, the connecting pins 60A, 62 and 60B are pushed by the connection switch pin 66 and slide rightward in FIG. 9. Thus, the connecting pin 60B is located inside the hole 46B and not located inside the hole 50, and the connecting pin 62 is located inside the hole 50 and not located inside the hole 46A. This state will hereinafter be referred to as the non-connected state. In the non-connected state, as shown in FIG. 12, the connecting pin 62 is slidable relative to the connecting pin 60A and the connecting pin 60B. As a result, as shown in FIG. 13, the second arm 42 is pivotable about the axis of the support pin 56 relative to the first arm 41. Therefore, the second arm 42 pivots about the axis of the support pin 56 while the first arm 41 does not pivot.

As shown in FIG. 3, the portion of the first arm 41 that is supported by the support pin 56 (specifically, the portion of the plate 41A around the hole 48 and the portion of the plate 41B around the hole 48) define a supported portion 415 that is pivotally supported on the cylinder head 12. The contact plate 41C defines a contact portion that contacts with the intake valve 22 with the tappet 26 therebetween.

As shown in FIG. 3, the internal combustion engine 10 includes a compression coil spring 68, as a lost motion spring, that urges the rocker arm 40 toward the intake cam 23A. A shaft 70 that extends along a winding axis 68*d* of the compression coil spring 68 is located inside the compression coil spring 68. The shaft 70 includes a first end portion 70*a*, and a second end portion 70*b* that is located on the second arm 42 side relative to the first end portion 70*a*. A spring seat 72 that receives the compression coil spring 68 is provided at the first end portion 70*a*.

The compression coil spring 68 includes a first end portion 68*a*, and a second end portion 68*b* that is located on the second arm 42 side relative to the first end portion 68*a*. A retainer 74 is supported at the second end portion 68*b*. The retainer 74 includes a disc-shaped top plate portion 74*a* and a cylinder-shaped tube portion 74*b*. The tube portion 74*b* extends from the top plate portion 74*a* along the axial direction of the shaft 70 toward the compression coil spring 68. The top plate portion 74*a* is supported on the second end portion 68*b* of the compression coil spring 68. The top plate portion 74*a* is in contact with the contact plate 42C of the second arm 42 of the rocker arm 40.

The spring seat 72, at least a portion of the shaft 70, at least a portion of the compression coil spring 68, and at least a portion of the tube portion 74*b* of the retainer 74 are located inside a hole 76 in the cylinder head 12.

The intake valve 22, the valve spring 32, the shaft 70, the retainer 74, the compression coil spring 68, and the support 35 are arranged parallel or substantially parallel to each other. The retainer 74 is located between the valve spring 32 and the support 35. The shaft 70 is located between the valve spring 32 and the support 35.

As shown in FIG. 2, as with the intake valve 22, the valve spring 32, the valve spring retainer 30, the rocker arm 40, the support 35, the compression coil spring 68, etc., are provided also for the exhaust valve 20. These elements are similar to those described above, and will not be described in detail below.

With the internal combustion engine 10 according to the present preferred embodiment, it is possible to switch the operation state of the intake valve 22 and the exhaust valve 20 by switching the state of the connection switch pins 66.

That is, when the connection switch pin 66 is switched to the connected state, the first arm 41 and the second arm 42 of the rocker arm 40 are connected together by the connecting pin 60B and the connecting pin 62 (see FIG. 10). When the intake cam 23A pushes the roller 43 of the rocker arm 40 following the rotation of the intake cam shaft 23, the first arm 41 and the second arm 42, as a single unit, pivot about the axis of the support pin 56 (see FIG. 11). As a result, the contact plate 41C of the first arm 41 pushes the intake valve 22, thus opening the intake opening 18 of the intake port 16. Similarly, when the exhaust cam 21A pushes the roller 43 of the rocker arm 40 following the rotation of the exhaust cam shaft 21, the first arm 41 and the second arm 42, as a single unit, pivot about the axis of the support pin 56. As a result, the contact plate 41C of the first arm 41 pushes the exhaust valve 20, thus opening the exhaust opening 17 of the exhaust port 14.

When the connection switch pin 66 is switched to the non-connected state, the connection between the first arm 41 and the second arm 42 by the connecting pin 60B and the connecting pin 62 is disconnected (see FIG. 9). The second arm 42 becomes pivotable relative to the first arm 41 (see FIG. 12). When the intake cam 23A pushes the roller 43 following the rotation of the intake cam shaft 23, the second arm 42 pivots about the axis of the support pin 56 while the first arm 41 does not pivot (see FIG. 13). Therefore, the contact plate 41C of the first arm 41 will not push the intake valve 22, and the intake opening 18 remains closed by the intake valve 22. Similarly, when the exhaust cam 21A pushes the roller 43 following the rotation of the exhaust cam shaft 21, the second arm 42 pivots about the axis of the support pin 56 while the first arm 41 does not pivot. Therefore, the contact plate 41C of the first arm 41 will not push the exhaust valve 20, and the exhaust opening 17 remains closed by the exhaust valve 20. Thus, in the present preferred embodiment, one or more of a plurality of cylinders are able to be brought to the inoperative state by switching the connection switch pin 66 to the non-connected state. For example, by making one or more cylinders inoperative while the load is small, it is possible to improve the fuel efficiency.

As described above, with the internal combustion engine 10 according to the present preferred embodiment, the rocker arm 40 includes the roller 43 that contacts with the cam 21A, 23A. As the cam 21A, 23A rotates, the roller 43 also rotates. Since the cam 21A, 23A and the roller 43 do not rub each other, there is little wear of the cam 21A, 23A and the rocker arm 40.

The internal combustion engine 10 is able to switch the operation state of the valve 20, 22. Therefore, the rocker arm 40 includes the second arm 42 that is pivotable relative to the first arm 41, and the roller 43 is supported on the second arm 42. With such a configuration, however, the range of movement of the roller 43 is large, and the roller 43 moves significantly downward in FIG. 3. The roller 43 will be closer to the valve spring retainer 30 (see the roller 43 indicated by phantom line in FIG. 3). Thus, as compared with an internal combustion engine where it is not possible to switch the valve operation state (i.e., an internal combustion engine in which the roller does not move), there is a concern about interference between the roller 43 and the valve spring retainer 30.

One may consider moving the position of the rocker arm 40 away from the valve spring retainer 30 in order to avoid interference between the roller 43 and the valve spring retainer 30. In such a case, however, there is a need to also change the position of the cam shaft 21, 23, etc., and this will increase the size of the cylinder head 12. On the other hand, one may consider moving the position of the valve spring retainer 30 away from the rocker arm 40 without changing the position of the rocker arm 40. In such a case, however, it may not be possible to ensure the needed valve lift amount.

However, with the internal combustion engine 10 according to the present preferred embodiment, the valve spring retainer 30 includes the cylindrical portion 34 and the cone-shaped portion 36 (see FIG. 4 and FIG. 5). The outer diameter of the cylindrical portion 34 is smaller than the outer diameter of the flange portion 38 that supports the first spring end portion 32*a* of the valve spring 32. Since the outer diameter of the cylindrical portion 34 is constant from the first end portion 34*a* to the second end portion 34*b*, it is possible to ensure a space radially outward of the cylindrical portion 34. Therefore, as shown in FIG. 3, it is possible to avoid interference between the roller 43 and the valve spring retainer 30 without moving the position of the rocker arm 40 away from the valve spring retainer 30 and without moving the position of the valve spring retainer 30 away from the rocker arm 40. Therefore, the internal combustion engine 10 according to the present preferred embodiment is able to switch the operation state of the valve 20, 22, wherein it is possible to reduce the wear of the cam 21A, 23A and the rocker arm 40, and it is possible both to reduce the size of the cylinder head 12 and to ensure a sufficient valve lift amount.

According to the present preferred embodiment, as shown in FIG. 5, the cone-shaped portion 36 of the valve spring retainer 30 includes the surface 36*a* that is perpendicular or substantially perpendicular to the axial direction, and the sloped surface 36*b* that extends radially outward while extending away from the surface 36*a* in the axial direction. Therefore, it is possible to increase the internal space of the second through hole 36*c* of the valve spring retainer 30. Thus, when the valve spring retainer 30 moves, together with the intake valve 22, toward the intake opening 18, the valve spring retainer 30 is less likely to interfere with other members such as the valve stem seal 25 (see FIG. 2). When the valve spring retainer 30 moves, together with the exhaust valve 20, toward the exhaust opening 17, the valve spring retainer 30 is less likely to interfere with other members such as the valve stem seal 25. Therefore, it is possible to ensure a sufficient valve lift amount without increasing the size of the cylinder head 12.

According to the present preferred embodiment, the lost motion spring that urges the second arm 42 toward the cam 21A, 23A is the compression coil spring 68 at least a portion of which is located on the side of the valve spring retainer 30. As described above, with the internal combustion engine 10 according to the present preferred embodiment, the rocker arm 40 is located in the vicinity of the valve spring retainer 30 while avoiding interference between the roller 43 of the rocker arm 40 and the valve spring retainer 30. In FIG. 2, the rocker arm 40 is able to be located at a lower position. Therefore, according to the present preferred embodiment, the rocker arm 40 is located at a position closer to the port 14, 16 than with conventional techniques. With this, the compression coil spring 68 is located closer to the port 14, 16. Therefore, according to the present preferred embodiment, fewer members are needed to support the compression coil spring 68, and it is possible to further reduce the weight of the cylinder head 12.

As described above, the second arm 42 of the rocker arm 40 is pivotally supported on the first arm 41. When the connection between the first arm 41 and the second arm 42 is disconnected, the roller 43 moves between the first position (the position indicated by a solid line in FIG. 3) and the second position (the position indicated by a phantom line in FIG. 3) that is farther away from the cam 21A, 23A than the first position. As indicated by a phantom line in FIG. 3, when the roller 43 is at the second position, at least a portion of the roller 43 is located closer to the second end portion 34*b* than to the first end portion 34*a* of the cylindrical portion 34 of the valve spring retainer 30 and closer to the axis 30*c* of the valve spring retainer 30 than to the flange portion 38, on a cross section that passes through an axis 30*c* of the valve spring retainer 30 and that is perpendicular or substantially perpendicular to the axial direction of the exhaust cam shaft 21. According to the present preferred embodiment, the distance between the roller 43 and the valve spring retainer 30 is short. The roller 43 and the valve spring retainer 30 are located in a compact arrangement. Therefore, it is possible to further reduce the size of the cylinder head 12.

The pressure generated between the valve spring retainer 30 and the cotter 28 tends to increase from the first end portion 34*a* toward the second end portion 34*b*. With the valve spring retainer 30, the thickness of the cylindrical portion 34 continuously increases from the first end portion 34*a* toward the second end portion 34*b*. Therefore, with the valve spring retainer 30, it is easy to ensure sufficient mechanical strength. Since there is no need to increase the size of the valve spring retainer 30 in order to ensure a sufficient mechanical strength, it is possible to reduce the space and reduce the weight.

While preferred embodiments of the present invention have been described above, it is needless to say that the present invention is not limited to the above-described preferred embodiments. Next, examples of alternative preferred embodiments will be briefly described.

In the preferred embodiments described above, the first arm 41 is configured so as not to be in contact with the cam 21A, 23A. In the preferred embodiments described above, the valve 20, 22 is brought to the inoperative state by switching the first arm 41 and the second arm 42 of the rocker arm 40 to the non-connected state. However, the first arm 41 may include a contact portion that contacts with the cam 21A, 23A after the second arm 42 starts pivoting as the roller 43 is pushed by the cam 21A, 23A. In such a case, it is possible to change the timing with which the valve 20, 22 is opened and closed by switching the first arm 41 and the second arm 42 to the non-connected state. Thus, it is possible to change the period in which the valve 20, 22 is open. For example, by extending the period in which the valve 20, 22 is open when the speed of the internal combustion engine 10 is high, it is possible to improve the performance at a high engine speed.

In the preferred embodiments described above, the internal combustion engine 10 is preferably a multi-cylinder engine. However, the internal combustion engine 10 may be a single-cylinder engine with which it is possible to change the timing with which the valve 20, 22 is opened/closed.

The terms and expressions used herein are used for explanation purposes and should not be construed as being restrictive. It should be appreciated that the terms and expressions used herein do not eliminate any equivalents of features illustrated and mentioned herein, but include various modifications falling within the claimed scope of the present invention. The present invention may be embodied in many different forms. The present disclosure is to be considered as providing examples of the principles of the present invention. These examples are described herein with the understanding that such examples are not intended to limit the present invention to preferred embodiments described herein and/or illustrated herein. Thus, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An internal combustion engine comprising:

a cylinder head;

a port in the cylinder head;

a valve in the cylinder head and that opens/closes the port;

a cam shaft rotatably supported on the cylinder head;

a cam provided on the cam shaft;

a rocker arm including a first arm, a second arm, and a roller, the first arm including a supported portion pivotally supported on the cylinder head and a contact portion that contacts with the valve, the second arm being pivotally supported on the first arm, and the roller being rotatably attached to the second arm and located between the supported portion and the contact portion of the first arm;

a connector that removably connects the first arm and the second arm;

a cotter attached to the valve;

a valve spring retainer to which the cotter is fitted and through which the valve passes; and a coil spring that includes a first spring end portion supported on the valve spring retainer and a second spring end portion supported on the cylinder head; wherein the valve spring retainer includes:

a cylindrical portion including a first end portion and a second end portion, the cylindrical portion including a first through hole with an inner diameter decreases from the first end portion toward the second end portion;

a cone-shaped portion extending from the second end portion of the cylindrical portion along an axial direction of the cylindrical portion, the cone-shaped portion including a second through hole with an inner diameter increases as the second through hole extends away from the second end portion; and a flange portion extending radially outward from the cone-shaped portion and supporting the first spring end portion of the coil spring;

an outer diameter of the cylindrical portion is constant from the first end portion to the second end portion;

an outer diameter of the cone-shaped portion increases as the cone-shaped portion extends away from the second end portion;

the second arm is supported on the first arm so that when the second arm is disconnected from the first arm, the roller moves between a first position and a second position that is farther away from the cam than the first position; and when the roller is at the second position, at least a portion of the roller is located closer to the second end portion than to the first end portion of the valve spring retainer and closer to an axis of the valve spring retainer than to the flange portion, on a cross section that passes through the axis of the valve spring retainer and that is perpendicular or substantially perpendicular to an axial direction of the cam shaft.

2. The internal combustion engine according to claim 1, further comprising a second coil spring at least a portion of which is located on a side of the valve spring retainer; wherein the second coil spring is in contact with the second arm and urges the second arm toward the cam.

3. The internal combustion engine according to claim 1, wherein the cone-shaped portion includes an inner surface that defines the second through hole; and the inner surface includes a surface that is perpendicular or substantially perpendicular to an axial direction of the cone-shaped portion, and a sloped surface that extends radially outward while extending away from the surface in the axial direction.

* * * * *